US009470117B2

(12) United States Patent
Hopkins

(10) Patent No.: US 9,470,117 B2
(45) Date of Patent: Oct. 18, 2016

(54) TRAPPED SUPPORT PIN FOR SPIRAL SPRING RETENTION IN A CAMSHAFT PHASER

(71) Applicant: Schaeffler Technologies AG & Co. KG, Herzogenaurach (DE)

(72) Inventor: Sarah Hopkins, Royal Oak, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/716,321

(22) Filed: May 19, 2015

(65) Prior Publication Data

US 2015/0345344 A1 Dec. 3, 2015

Related U.S. Application Data

(60) Provisional application No. 62/005,528, filed on May 30, 2014.

(51) Int. Cl.

| | |
|---|---|
| ***F01L 1/46*** | (2006.01) |
| ***F01L 1/34*** | (2006.01) |
| *F01L 1/344* | (2006.01) |

(52) U.S. Cl.

CPC .. *F01L 1/34* (2013.01); *F01L 1/46* (2013.01); *F01L 2001/34483* (2013.01); *Y10T 29/49249* (2015.01)

(58) Field of Classification Search

CPC ..... F01L 2001/3445; F01L 2001/34479; F01L 2001/34483; F01L 1/46

USPC ..... 123/90.15, 90.17, 90.31

See application file for complete search history.

(56) References Cited

U.S. PATENT DOCUMENTS

2013/0036993 A1* 2/2013 Nakamura ..... F01L 1/3442 123/90.15

FOREIGN PATENT DOCUMENTS

EP 1486645 12/2004

* cited by examiner

*Primary Examiner* — Jorge Leon, Jr.

(74) *Attorney, Agent, or Firm* — Simpson & Simpson, PLLC

(57) ABSTRACT

A camshaft phaser, including: an axis of rotation; a drive sprocket arranged to receive torque; a stator non-rotatably connected to the drive sprocket; a rotor at least partially rotatable with respect to the stator, arranged to non-rotatably connect to a camshaft and including first and second radially disposed sides facing, respectively, in first and second opposite axial directions parallel to the axis of rotation, a through-bore connecting the first and second radially disposed sides, and a support pin including a first portion disposed in the through-bore and a second portion extending past the second radially disposed side in the second axial direction; and a positioning spring engaged with the second portion and the stator to urge the rotor in a circumferential direction, wherein a line parallel to the axis of rotation passes through the first portion and material forming the rotor.

20 Claims, 4 Drawing Sheets

TRAPPED SUPPORT PIN FOR SPIRAL SPRING RETENTION IN A CAMSHAFT PHASER

CROSS-REFERENCE TO RELATED APPLICATIONS

This application claims the benefit under 35 U.S.C. §119(e) of U.S. Provisional Patent Application No. 62/005,528, filed May 30, 2014, which application is incorporated herein by reference in its entirety.

TECHNICAL FIELD

The present disclosure relates to a camshaft phaser having a trapped support pin for engaging a positioning spring for a rotor. In particular, the support pin is disposed in a through-bore of the stator without a press fit and is axially restrained by a flanged end in contact with a step in the through-bore and by a cover attached to one side of the stator.

BACKGROUND

It is known to use a spring retention plate or a press-fit component to engage and retain a positioning spring for a rotor. However, the use of a spring retention plate increases the parts count and cost for the phaser and may increase the axial extent of the phaser. Press-fitting components is relatively costly since subsequent grinding operations are required.

SUMMARY

According to aspects illustrated herein, there is provided a camshaft phaser, including: an axis of rotation; a drive sprocket arranged to receive torque; a stator non-rotatably connected to the drive sprocket; a rotor at least partially rotatable with respect to the stator, arranged to non-rotatably connect to a camshaft and including first and second radially disposed sides facing, respectively, in first and second opposite axial directions parallel to the axis of rotation, a through-bore connecting the first and second radially disposed sides, and a support pin including a first portion disposed in the through-bore and a second portion extending past the second radially disposed side in the second axial direction; and a positioning spring engaged with the second portion and the stator to urge the rotor in a circumferential direction, wherein a line parallel to the axis of rotation passes through the first portion and material forming the rotor.

According to aspects illustrated herein, there is provided a camshaft phaser, including: an axis of rotation; a drive sprocket arranged to receive torque; a stator non-rotatably connected to the drive sprocket; a rotor at least partially rotatable with respect to the stator, arranged to non-rotatably connect to a camshaft, and including first and second radially disposed sides facing, respectively, in first and second opposite axial directions parallel to the axis of rotation, a through-bore connecting the first and second radially disposed sides and including a first portion open to the first radially disposed side and with a first diameter and a second portion open to the second radially disposed side and with a second diameter less than the first diameter, and a support pin including a first portion including a first segment disposed in the first portion of the through-bore and a second segment disposed in the second portion of the through-bore and a second portion extending past the second radially disposed side in the second axial direction; and a positioning spring engaged with the stator and the second portion of the support pin and urging the rotor in a circumferential direction, wherein a line parallel to the axis of rotation passes through the first portion of the support pin and is radially inward or outward of the second portion of the support pin.

According to aspects illustrated herein, there is provided a method of securing a positioning spring for a camshaft phaser including an axis of rotation, a drive sprocket arranged to receive torque, a stator non-rotatably connected to the drive sprocket, and a rotor rotatable with respect to the stator, the method including: connecting first and second radially disposed sides, facing, respectively, in first and second opposite axial directions parallel to the axis of rotation, of the rotor with a through-bore; disposing a first portion of a support pin in the through-bore; axially displacing a second portion of the support pin beyond the second radially disposed side in the second axial direction; blocking, with the rotor, further axial displacement of the support pin in the second axial direction; engaging the positioning spring with the stator and the second portion of the support pin; and urging the rotor in a rotational direction with the support spring.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
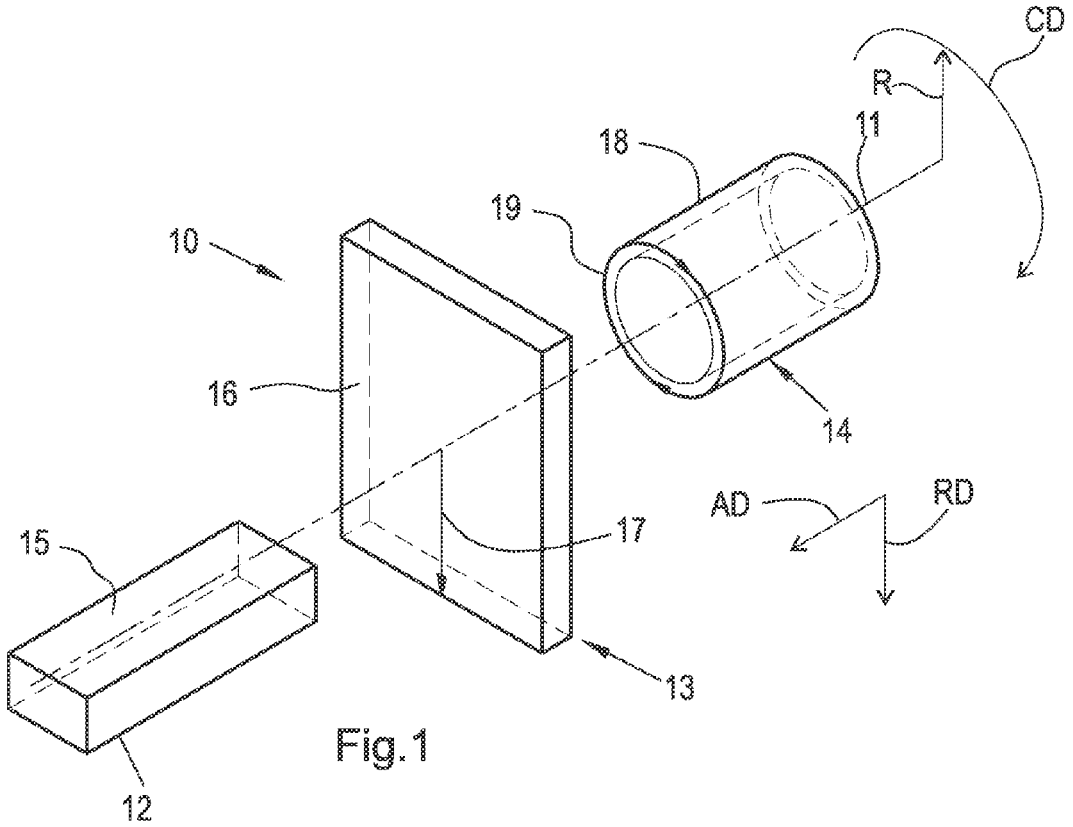
FIG. 1 is a perspective view of a cylindrical coordinate system demonstrating spatial terminology used in the present application.

FIG. 1 is a perspective view of cylindrical coordinate system 10 demonstrating spatial terminology used in the present application. The present application is at least partially described within the context of a cylindrical coordinate system. System 10 includes longitudinal axis 11, used as the reference for the directional and spatial terms that follow. Axial direction AD is parallel to axis 11. Radial direction RD is orthogonal to axis 11. Circumferential direction CD is defined by an endpoint of radius R (orthogonal to axis 11) rotated about axis 11.

To clarify the spatial terminology, objects 12, 13, and 14 are used. An axial surface, such as surface 15 of object 12, is formed by a plane co-planar with axis 11. Axis 11 passes through planar surface 15; however any planar surface co-planar with axis 11 is an axial surface. A radial surface, such as surface 16 of object 13, is formed by a plane orthogonal to axis 11 and co-planar with a radius, for example, radius 17. Radius 17 passes through planar surface 16; however any planar surface co-planar with radius 17 is a radial surface. Surface 18 of object 14 forms a circumferential, or cylindrical, surface. For example, circumference 19 is passes through surface 18. As a further example, axial movement is parallel to axis 11, radial movement is orthogonal to axis 11, and circumferential movement is parallel to circumference 19. Rotational movement is with respect to axis 11. The adverbs "axially," "radially," and "circumferentially" refer to orientations parallel to axis 11, radius 17, and circumference 19, respectively. For example, an axially disposed surface or edge extends in direction AD, a radially disposed surface or edge extends in direction R, and a circumferentially disposed surface or edge extends in direction CD.

Figure 2:
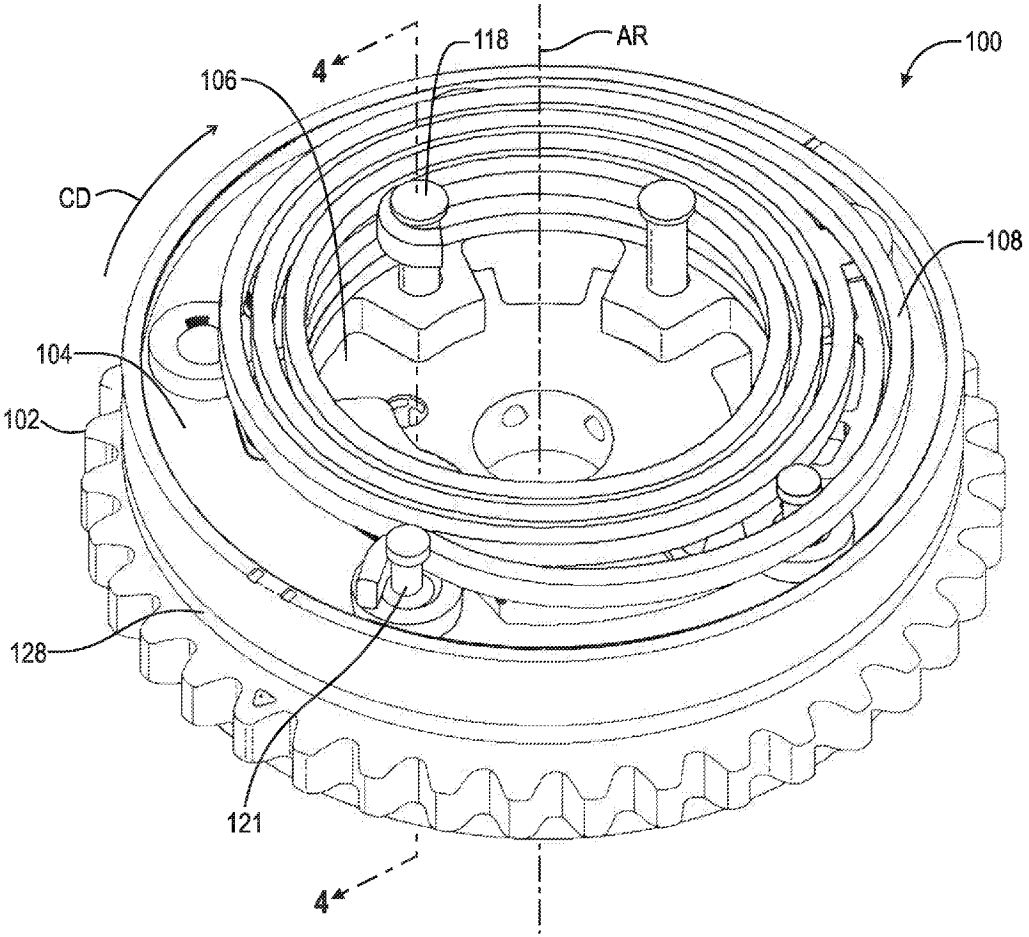
FIG. 2 is a perspective view of a camshaft phaser with a support pin in a through-bore.

FIG. 2 is a perspective view of camshaft phaser 100 with a support pin in a through-bore.

Figure 3:
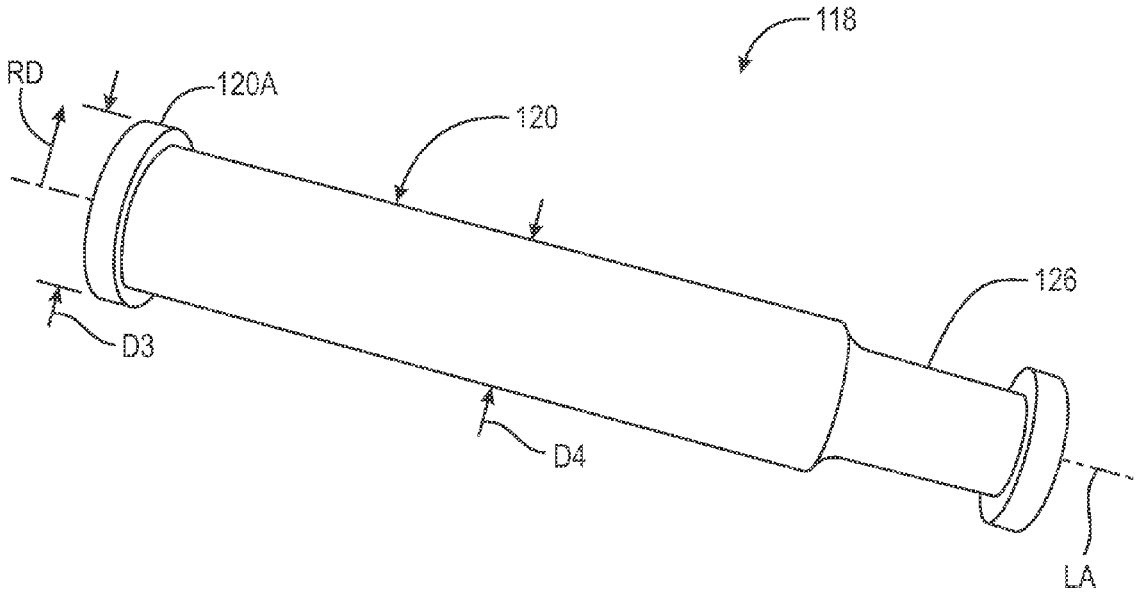
FIG. 3 is a perspective view of the support pin of FIG. 2.

FIG. 3 is a perspective view of the support pin of FIG. 2.

Figure 4:
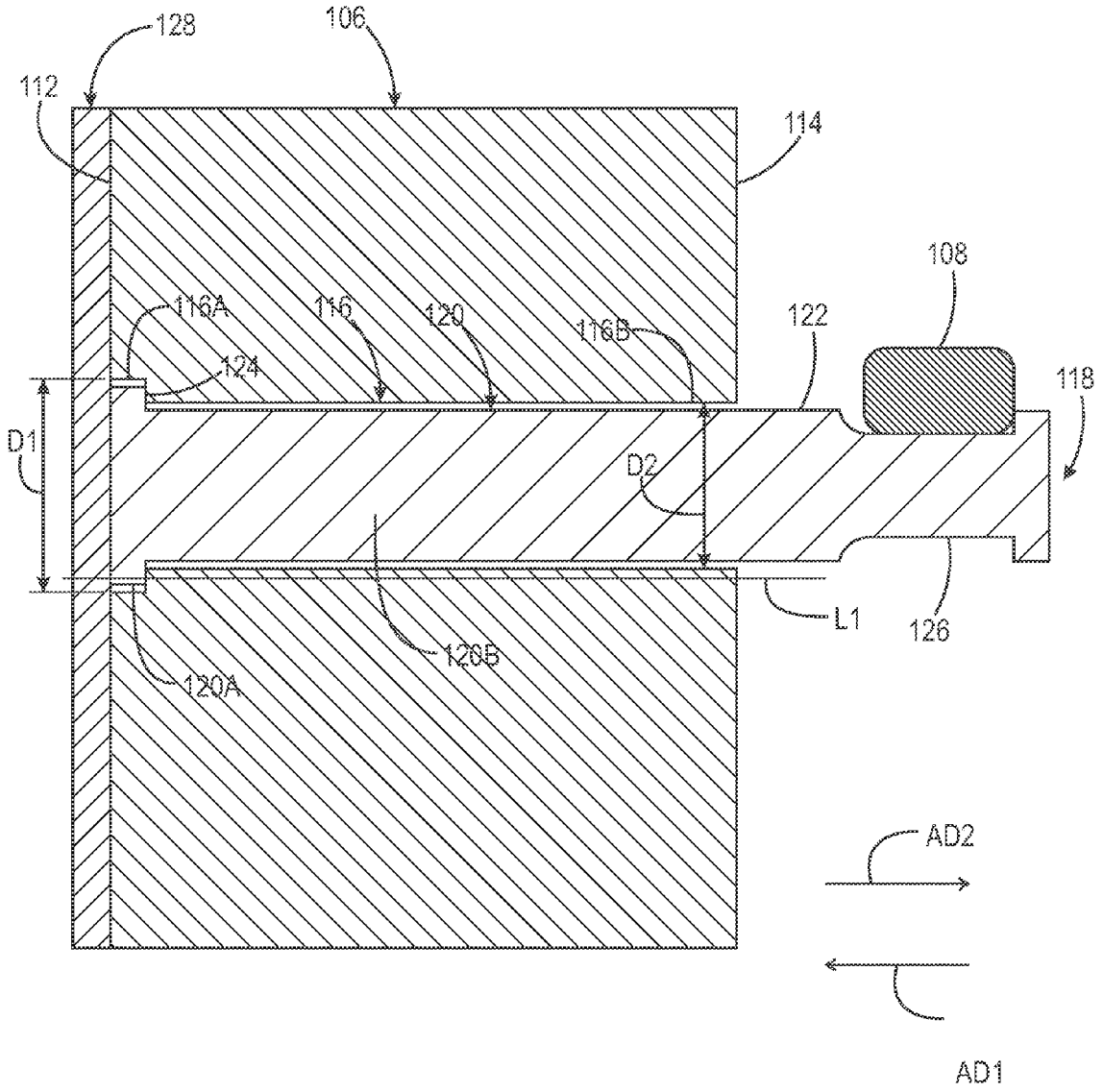
FIG. 4 is a cross-sectional view generally along line 4-4 in FIG. 2 showing the rotor, support pin, and positioning spring of FIG. 2.

FIG. 4 is a cross-sectional view generally along line 4-4 in FIG. 2 showing the rotor, support pin, and positioning spring of FIG. 2. The following should be viewed in light of FIGS. 2 through 4. Camshaft phaser 100 includes axis of rotation AR, drive sprocket 102 arranged to receive torque, stator 104 non-rotatably connected to drive sprocket 102, rotor 106, and positioning spring 108. Rotor 106 is at least partially rotatable with respect to stator 104 to implement phasing operations and is arranged to non-rotatably connect to a camshaft (not shown). Rotor 106 includes radially disposed sides 112 and 114, through-bore 116 connecting sides 112 and 114, and support pin 118. Clearance between bore 116 and pin 118 is exaggerated in FIG. 4 for purposes of clarity. Sides 112 and 114 face in opposite axial directions AD1 and AD2, respectively, parallel to axis AR. Pin 118 includes portion 120 disposed in through-bore 116, and portion 122 extending past side 114. Positioning spring 108 is engaged with portion 122 and stator 104, for example, at pin 121, and urges rotor 106 in circumferential direction CD, for example, to a default phase position. Line L1, parallel to axis AR, passes through portion 120, in particular, segment 120A, and material forming rotor 106.

Through-bore 116 includes portion 116A with diameter D1 at side 112 and portion 116B with diameter D2, less than diameter D1, at side 114. Annular surface 124 connects portions 116A and 116B. In an example embodiment, surface 124 is a radially disposed surface facing in direction AD1. Portion 120 includes segment 120A disposed in portion 116A and segment 120B disposed in portion 116B. Line L1 passes through segment 120A and rotor 106. In an example embodiment, segment 120A is in contact with annular surface 124 and the contact of segment 120A with annular surface 124 blocks displacement of support pin 118 in axial direction AD2. Line L1 passes through segment 120A and annular surface 124.

Portion 122 includes annular recess 126 and positioning spring 108 is arranged to engage support pin 118 at annular recess 126. Support pin 118 includes longitudinal axis LA and segment 120A extends beyond segment 120B in radial direction RD orthogonal to longitudinal axis LA. In an example embodiment, phaser 100 includes cover 128 fixedly secured to side 112 and covering through bore 116.

Advantageously, through-bore 116 and pin 118 address the positioning spring retention problems noted above.

1. Press-fit operations are not required. Diameters D3 and D4 of pin 118 are less than diameters D1 and D2 of through-bore 116; therefore, pin 118 can be inserted in through-bore 116 without press-fitting. As a result, the extra time and cost associated with press-fitting and grinding operations is avoided.

2. Contact of segment 120A with surface 124 prevents further displacement of pin 118 in direction AD2 without need of a press-fit.

3. Cover 128 restrains pin 118 in axial direction AD1 without need of a press-fit.

4. Cover 128 is part of a typical camshaft phaser; therefore, no extra parts are needed. For example, a spring retention plate is not required.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A camshaft phaser, comprising:
- an axis of rotation;
- a drive sprocket arranged to receive torque;
- a stator non-rotatably connected to the drive sprocket;
- a rotor:
  - at least partially rotatable with respect to the stator;
  - arranged to non-rotatably connect to a camshaft; and,
  - including:
    - first and second radially disposed sides facing, respectively, in first and second opposite axial directions parallel to the axis of rotation;
    - a through-bore connecting the first and second radially disposed sides; and,
    - a support pin including:
      - a first portion disposed in the through-bore; and,
      - a second portion extending past the second radially disposed side in the second axial direction; and,
- a positioning spring engaged with the second portion and the stator to urge the rotor in a circumferential direction, wherein a line parallel to the axis of rotation passes through the first portion and material forming the rotor.

2. The camshaft phaser of claim 1, wherein the through-bore has:
- a first diameter at the first radially disposed side; and,
- a second diameter, less than the first diameter, at the second radially disposed side.

3. The camshaft phaser of claim 1, wherein the through-bore:
- includes a first portion with a first diameter;
- includes a second portion with a second diameter, less than the first diameter; and,
- forms an annular surface in the stator connecting the first and second portions of the through-bore.

4. The camshaft phaser of claim 3, wherein the first portion of the support pin includes:

a first segment disposed in the first portion of the through-bore; and, a second segment disposed in the second portion of the through-bore.

5. The camshaft phaser of claim 4, wherein the line parallel to the axis of rotation passes through the first segment of the first portion of the support pin and the material forming the rotor.

6. The camshaft phaser of claim 4, wherein:

the first segment of the first portion of the support pin is in contact with the annular surface; and, the contact of the first segment of the first portion of the support pin with the annular surface blocks displacement of the support pin in the second axial direction.

7. The camshaft phaser of claim 6, wherein the line parallel to the axis of rotation passes through the first segment of the first portion of the support pin and the annular surface.

8. The camshaft phaser of claim 3, wherein:

the second portion of the support pin includes an annular recess; and, the positioning spring is arranged to engage the support pin at the annular recess.

9. The camshaft phaser of claim 4, wherein:

the support pin includes a longitudinal axis; and, the first segment of the first portion of the support pin extends beyond the second segment of the first portion of the support pin in a radial direction with respect to the longitudinal axis.

10. The camshaft phaser of claim 1, further comprising a cover:

fixedly secured to the first radially disposed side; and, covering the through bore.

11. A camshaft phaser, comprising:

an axis of rotation;

a drive sprocket arranged to receive torque;

a stator non-rotatably connected to the drive sprocket;

a rotor:

at least partially rotatable with respect to the stator;

arranged to non-rotatably connect to a camshaft; and, including:

first and second radially disposed sides facing, respectively, in first and second opposite axial directions parallel to the axis of rotation;

a through-bore connecting the first and second radially disposed sides; and including:

a first portion open to the first radially disposed side and with a first diameter; and, a second portion open to the second radially disposed side and with a second diameter less than the first diameter; and;

a support pin including:

a first portion including a first segment disposed in the first portion of the through-bore and a second segment disposed in the second portion of the through-bore; and, a second portion extending past the second radially disposed side in the second axial direction; and, a positioning spring engaged with the stator and the second portion of the support pin and urging the rotor in a circumferential direction, wherein a line parallel to the axis of rotation passes through the first portion of the support pin and is radially inward or outward of the second portion of the support pin.

12. The camshaft phaser of claim 11, wherein the line parallel to the axis of rotation passes through the first segment of the first portion of the support pin and material forming the rotor.

13. The camshaft phaser of claim 11, wherein:

the through-bore forms an annular surface in the rotor connecting the first and second portions of the through-bore.

14. The camshaft phaser of claim 13, wherein:

the first segment of the first portion of the support pin is in contact with the annular surface; and, the contact of the first segment of the first portion of the support pin with the annular surface blocks displacement of the support pin in the first axial direction.

15. The camshaft phaser of claim 14, wherein the line parallel to the axis of rotation passes through the first segment of the first portion of the support pin and the annular surface.

16. The camshaft phaser of claim 11, wherein:

the first segment of the first portion of the support pin has a third diameter greater than the second diameter; and, the second segment of the first portion of the support pin has a fourth diameter less than the second diameter.

17. The camshaft phaser of claim 11, further comprising a cover:

fixedly secured to the first radially disposed side; and, covering the through bore.

18. A method of securing a positioning spring for a camshaft phaser including an axis of rotation, a drive sprocket arranged to receive torque, a stator non-rotatably connected to the drive sprocket, and a rotor rotatable with respect to the stator, the method comprising:

connecting first and second radially disposed sides, facing, respectively, in first and second opposite axial directions parallel to the axis of rotation, of the rotor with a through-bore;

disposing a first portion of a support pin in the through-bore;

axially displacing a second portion of the support pin beyond the second radially disposed side in the second axial direction;

blocking, with the rotor, further axial displacement of the support pin in the second axial direction;

engaging the positioning spring with the stator and the second portion of the support pin; and, urging the rotor in a rotational direction with the positioning spring.

19. The method of claim 18, further comprising:

forming a first portion of the through-bore, open to the first radially disposed side, to have a first diameter;

forming a second portion of the through-bore, open to the second radially disposed side, to have a second diameter less than the first diameter;

forming the first portion of the support pin to have a third diameter greater than the second diameter; and, forming the second portion of the support pin to have a fourth diameter less than the second diameter.

20. The method of claim 18, further comprising:

fixedly connecting a cover to the first radially disposed side; and, blocking displacement of the support pin in the first axial direction with the cover.

* * * * *